US006499713B1

(12) United States Patent
Paoluccio

(10) Patent No.: US 6,499,713 B1
(45) Date of Patent: Dec. 31, 2002

(54) PORTABLE APPARATUS FOR HOLDING AN OPEN BOOK

(76) Inventor: John J. Paoluccio, 3530 Kiernan, Modesto, CA (US) 95356

( * ) Notice: Subject to any disclaimer, the term of this patent is extended or adjusted under 35 U.S.C. 154(b) by 0 days.

(21) Appl. No.: 09/729,438

(22) Filed: Dec. 4, 2000

(51) Int. Cl.[7] ..... A47B 97/06
(52) U.S. Cl. ..... 248/447.2; 248/451
(58) Field of Search ..... 248/447.2, 442.2, 248/443, 451, 453, 444, 231.61, 316.1

(56) References Cited

U.S. PATENT DOCUMENTS

| | | | | | |
|---|---|---|---|---|---|
| 2,679,372 | A | * | 5/1954 | May | 248/205 |
| 3,021,637 | A | * | 2/1962 | Huffman | 45/57 |
| 4,330,692 | A | * | 5/1982 | Foreman, Sr. | 179/178 |
| 4,901,969 | A | * | 2/1990 | Yaeger | 248/455 |
| 5,362,023 | A | * | 11/1994 | Reyes | 248/461 |
| 5,372,348 | A | * | 12/1994 | Cheng | 248/447.2 |
| 5,590,607 | A | * | 1/1997 | Howard | 108/98 |
| 5,707,036 | A | * | 1/1998 | Dunbar | 248/447.2 |
| 6,109,658 | A | * | 8/2000 | Moore | 281/42 |

* cited by examiner

*Primary Examiner*—Anita King
*Assistant Examiner*—A. Joseph Wujciak, III
(74) *Attorney, Agent, or Firm*—Robert S. Smith

(57) ABSTRACT

An apparatus for holding an associated open book on which some indicia appears which includes apparatus for gripping an associated work surface and apparatus for supporting an associated article on which indicia appears, the apparatus for supporting being fixed to said apparatus for gripping. In some forms of the invention the apparatus for gripping an associated work surface comprises a generally U-shaped clamp dimensioned and configured for engaging an associated generally horizontal planar work surface. The apparatus for supporting may be a first generally planar member. The generally planar member may have an opening formed therein. A substantial part of the generally U-shaped clamp has a surface area that is less than the area of the opening in the generally planar member. The first generally planar member may include at least one rib formed therein. The at least one rib may extend generally perpendicular to the associated work surface when said apparatus for holding an associated open book is installed on the associated work surface. The apparatus for holding an associated open book may further include at least one additional rib formed in the first generally planar member. The apparatus may further include at least one additional rib that extends in generally parallel relationship to said at least one rib.

3 Claims, 5 Drawing Sheets

PORTABLE APPARATUS FOR HOLDING AN OPEN BOOK

BACKGROUND OF THE INVENTION

The invention relates to a book holder apparatus for holding an open book and particularly for holding a book for reading. While the invention has particular application to a portable book holder for attachment to a school desk it will be understood that the invention has application for other purposes. School desks have a relatively small amount of surface area of several square feet. This area is used to accommodate writing papers, pens and pencils, reference material, calculators and textbooks. The desk space can become very crowded and it is difficult to manage all the writing and reading material on the desk. This invention allows the student to quickly slide or clip on the portable book holder on the edge of the desk. This, in essence, provides additional surface area for holding a book in a vertical plane without using up any of the horizontal surface area of the desk. This provides for a convenient location, on the edge of the desk, to hold a book for reading without using up valuable surface school desk space. The student may refer back to the book at intervals or merely have a number of books held in a number of holders in accordance with the present invention. Many other applications will be apparent to those skilled in the art. The invention has utility for anyone who wants to refer to a book while doing something else. For example, a cook may desire to have an open cookbook held in an upright position for reference while the cook is preparing a meal. Similarly a mechanic may wish to periodically refer to a page of a book while repairing a machine.

The prior art includes various relatively complex book stands. Many of such book stands have relatively large flat bases that are positioned on a flat desk surface. Such units are often bulky and expensive. In addition they occupy too much desk or table space and are not particularly portable. Some students utilize piles of books as a support for a single open book. Such supports aren't very effective and often result in books falling off a desk even during a class. Such an event may result in embarrassment to the student as well as disturbing and disrupting the class.

SUMMARY OF THE INVENTION

It is an object of the present invention to provide apparatus that is portable. Another object of the invention is to provide apparatus that will take up very little space on a surface of a desk or table because it is common to have insufficient space available in the flat surface area on a desk or other work or study surface.

Yet another object of the invention is to provide apparatus that is compact and readily portable.

Still another object of the invention is to provide apparatus that can be manufactured very easily and inexpensively.

It is now been found that these and other objects of the invention may be attained in an apparatus for holding an associated open book on which some indicia appears which includes means for gripping an associated work surface and means for supporting an associated article on which indicia appears, the means for supporting being fixed to said means for gripping.

In some forms of the invention the means for gripping an associated work surface comprises a generally U-shaped clamp dimensioned and configured for engaging an associated generally horizontal planar work surface. The means for supporting may be a first generally planar member. The generally planar member may have an opening formed therein. A substantial part of the generally U-shaped clamp has a surface area that is less than the area of the opening in the generally planar member. The first generally planar member may include at least one rib formed therein. The at least one rib may extend generally perpendicular to the associated work surface when said apparatus for holding an associated open book is installed on the associated work surface. The apparatus for holding an associated open book may further include at least one additional rib formed in the first generally planar member. The apparatus may further include at least one additional rib that extends in generally parallel relationship to said at least one rib.

The generally U-shaped clamp may include a generally planar plate dimensioned and configured for engaging the upper face of an associated work surface, the generally planar plate may have a lip extending away from the upper face of the associated work surface, the lip may be dimensioned and configured for engaging at least, the pages of an associated book supported on the first generally planar member.

The generally U-shaped clamp may include a generally planar plate dimensioned and configured for engaging the upper face of an associated work surface. The generally planar plate may have a lip extending away from the upper face of the associated work surface. The lip may be dimensioned and configured for engaging at least, the pages of an associated book supported on the first generally planar member.

The means for gripping may include a generally C-shape spring clamp. The apparatus may further include a friction slip washer disposed between the C-shaped spring clamp and the rest of the apparatus to allow the apparatus to swivel to any of a plurality of angles with a slight force while attached securely to the associated desk by the C-shaped spring steel clamp.

BRIEF DESCRIPTION OF THE DRAWING

The invention will be better understood by reference to the accompanying drawings in which.

DESCRIPTION OF THE PREFERRED EMBODIMENTS

Figure 1:
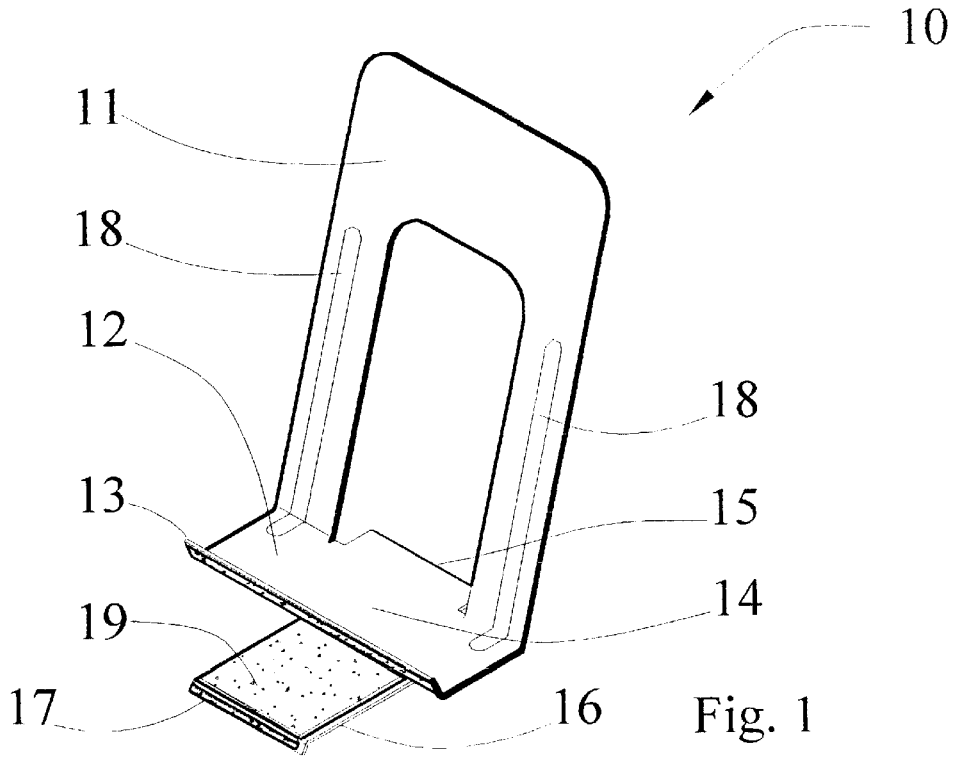
FIG. 1 is a schematic view of one form of the present invention.
Figure 2:
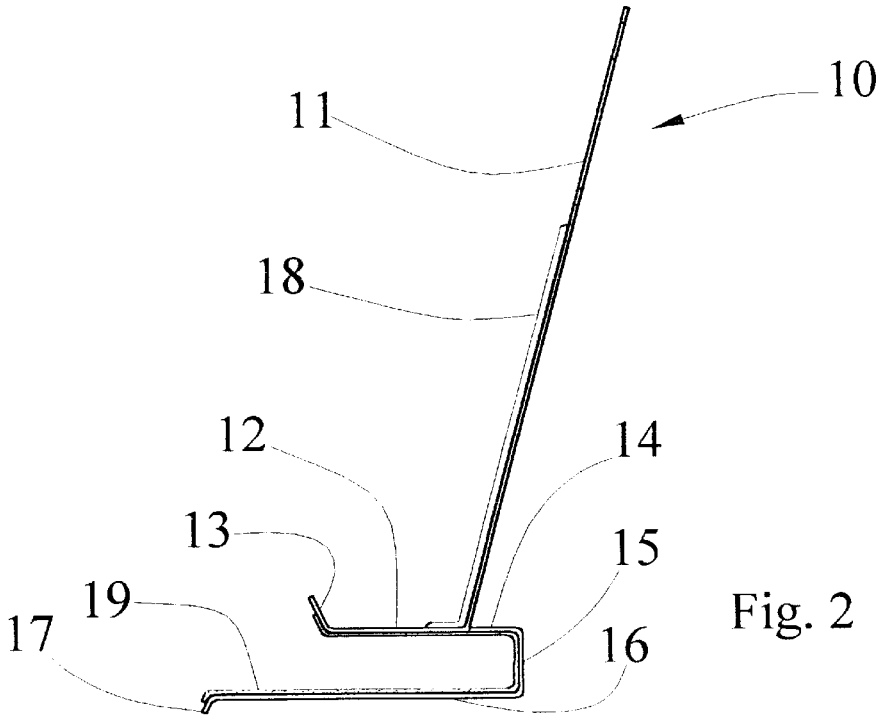
FIG. 2 is a side elevation view of the apparatus shown in FIG. 1.
Figure 3:
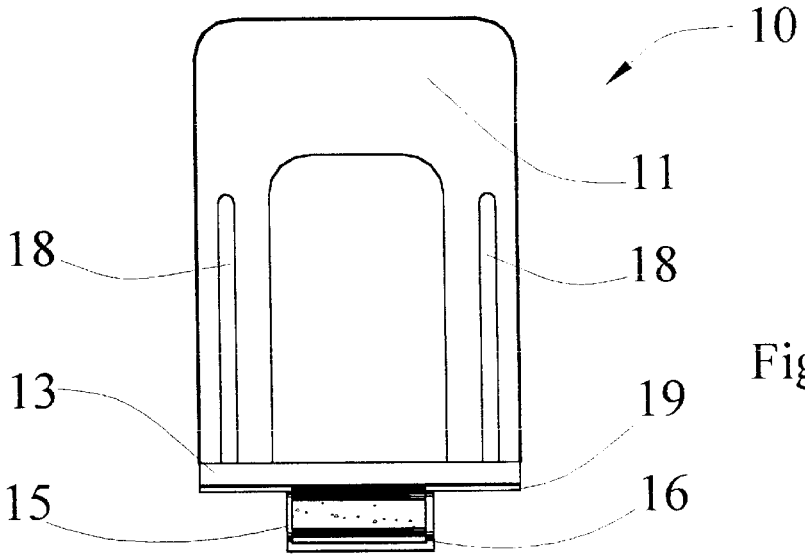
FIG. 3 is a front elevation view of the apparatus shown in FIG. 1.
Figure 4:
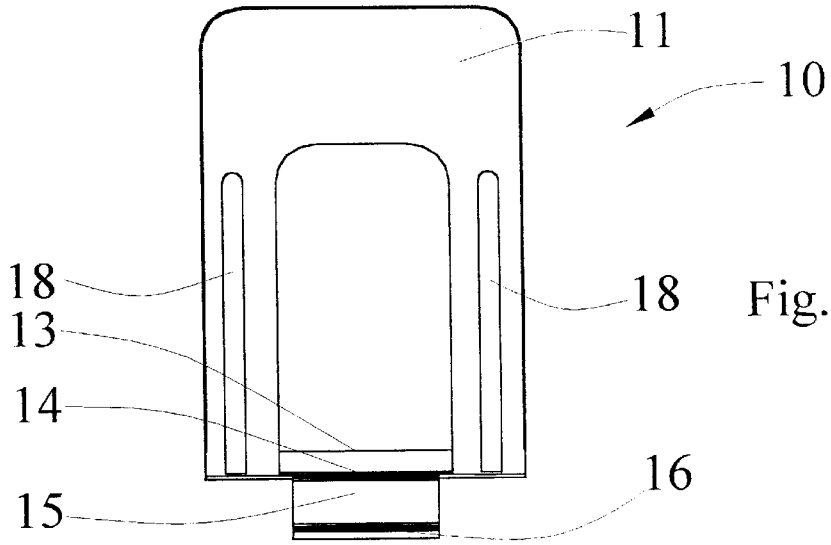
FIG. 4 shows a rear elevation view of the upright shown in FIG. 1.
Figure 5:
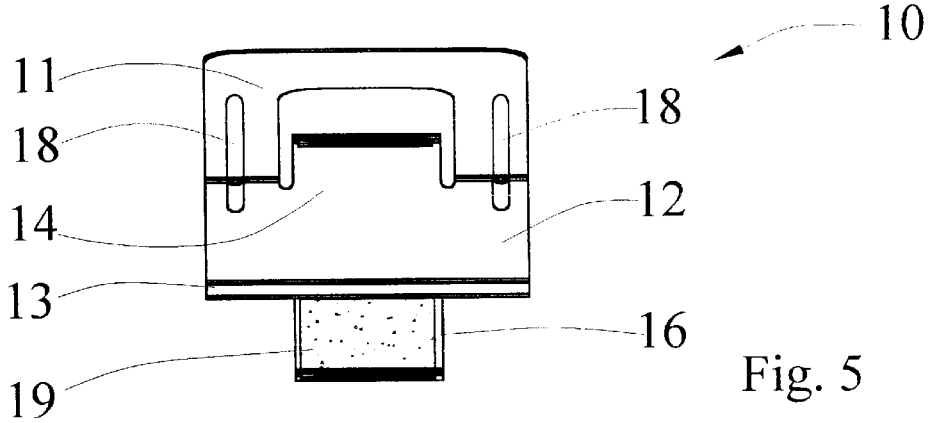
FIG. 5 is a plain view of the apparatus shown in FIG. 1.
Figure 6:
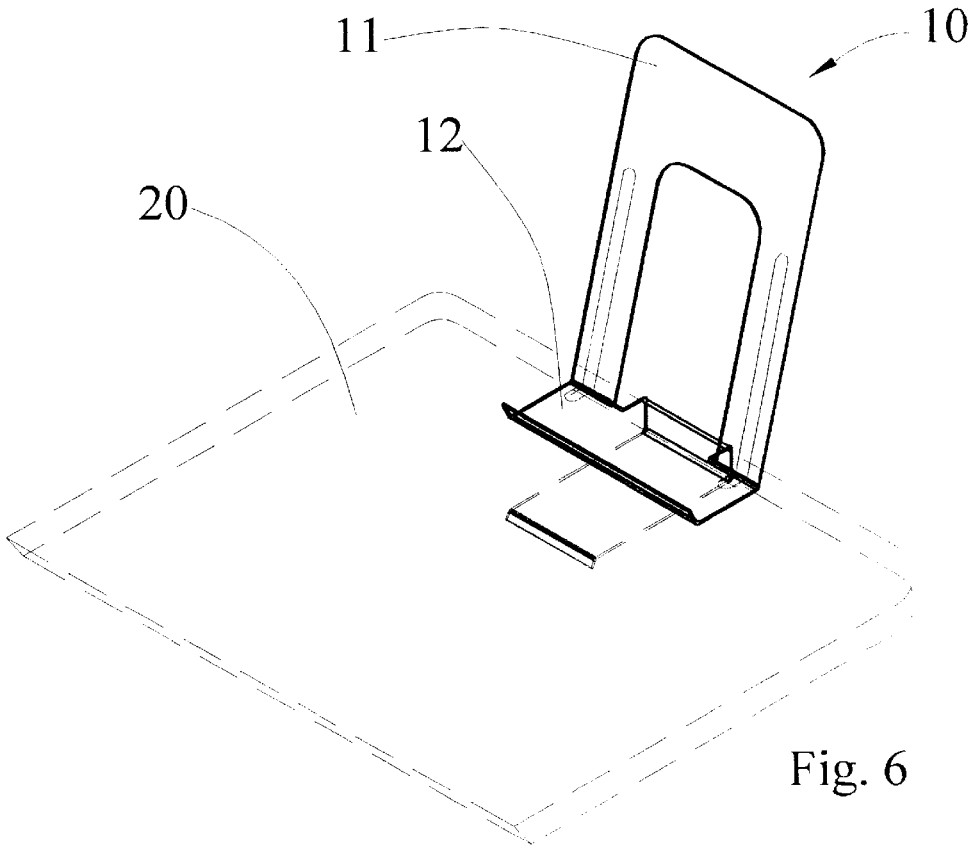
FIG. 6 is a schematic front view of the apparatus of FIG. 1.
Figure 7:
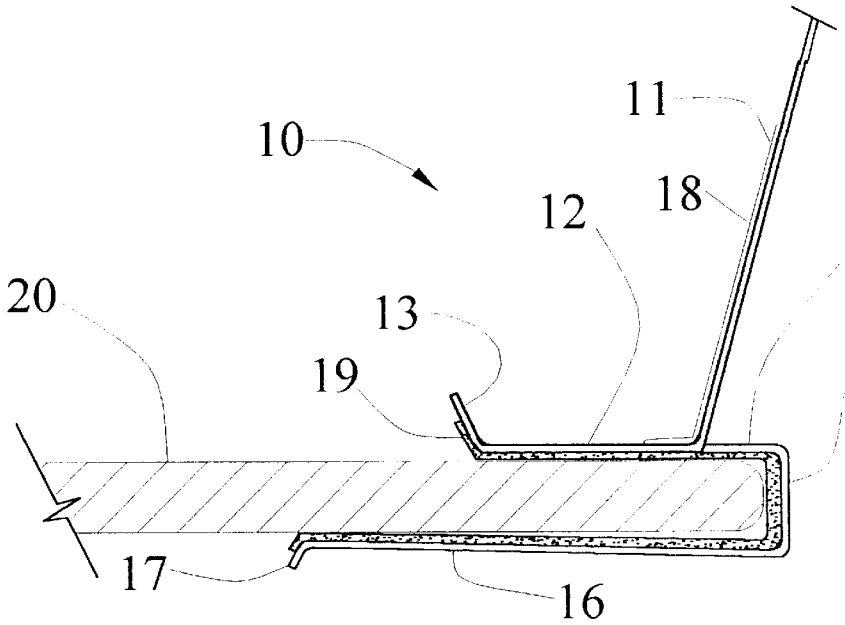
FIG. 7 is an enlarged schematic side view of the apparatus of FIG. 1.
Figure 8:
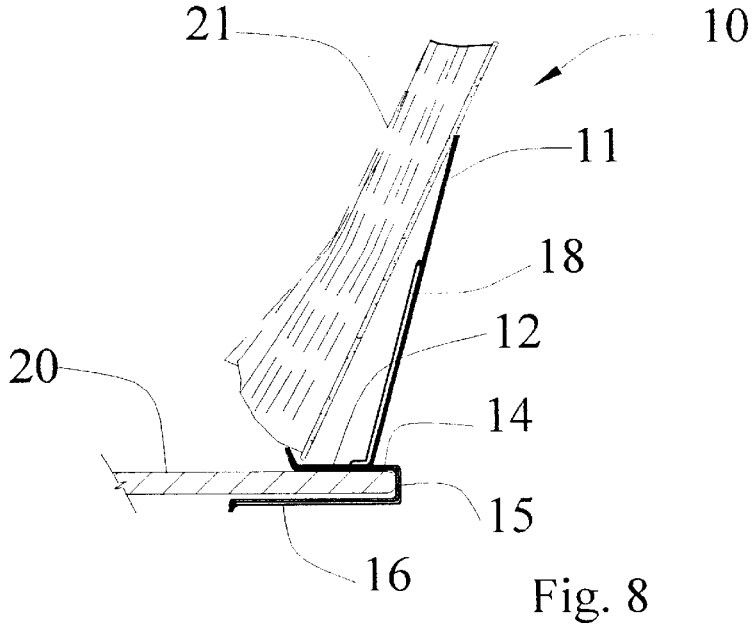
FIG. 8 is a schematic side view of the apparatus of FIG. 1 holding a book.

Referring now to FIGS. 1–8 there is shown one form of the apparatus for holding an open book 10 in accordance with the present invention. The apparatus 10 includes, in one form of the present invention, a sheet metal construction. In other forms of the invention the construction may be a molded plastic construction. Suitable plastic materials include polycarbonate and high-density polyethylene. Such plastic materials are lightweight, strong and flexible and are preferred for many applications.

In the illustrated preferred embodiment a support 11 extends upwardly from a desk or table 20 at an angle of approximately 10 degrees from a vertical plane. The support 11 is generally planar and has elongated ribs 18, 18 extending in generally perpendicular relationship to the desk or table 20. In the usual and customary manner of making sheet metal and even plastic parts of the ribs 18, 18 provide increased rigidity as compared to a flat piece of metal or plastic. The support 11 is preferably manufactured in a stamping operation from a single piece of sheet metal. The stamping operation also forms a plate 12 that is horizontal and is disposed along the upper surface of the desk 20 in the installed position. Also formed in the same stamping operation is a plate 16 that extends along the lower surface of the desk 20 with a C-shaped section 15 intermediate the plates 12 and 16. Those skilled in the art will recognize that a single piece of sheet metal is stamped to produce the support 11, the plates of 12, 16 as well as the C-shaped section 15. In the stamping operation a lip or flange 13 having an angle of approximately 10 degrees from a vertical plane is formed on the plate 12. Similarly, a flange 17 is formed at the axial extremity of the plate 16 that is most remote from the C-shaped section 15. The flanges at 17 are provided to facilitate attachment of the generally U-shaped clamp formed by the plate 12, C-shaped section 15, and the plate 16 to an associated desk or table 20. In the preferred embodiment, a plastic lining 19 is disposed along the surfaces of the lip 13, the plate 12, the C-shaped section 15, the plate 16 and the lip 17 to avoid any damage to the desk 20. In alternative environments of the invention cork, rubber, or other materials such as felt material may be used instead of the plastic material that is used for gripping in the preferred embodiment.

The geometry of the various elements of the present invention allows the apparatus to be manufactured from a single piece of sheet metal. It will be seen that the C-shaped section 15 and the plate 16 as well as the lip 17 are formed from the metal that is stamped out of the opening within the support 11. Accordingly, the product can be manufactured relatively inexpensively with very little waste. It will be seen that the apparatus in accordance with the invention may be used to support as little as a single sheet of paper or much heavier and more cumbersome books or other objects. Advantageously, the lip 13 touches the pages of a book 21 sitting on the apparatus in accordance with the present invention. Thus the lip 13 helps to secure the book 21 and prevent the book 21 from moving toward the user (not shown).

It will be understood that the apparatus in accordance with the present invention may be used with a clip or friction gripper to hold one or more sheets of paper as an alternative to holding an entire book.

Figure 9:
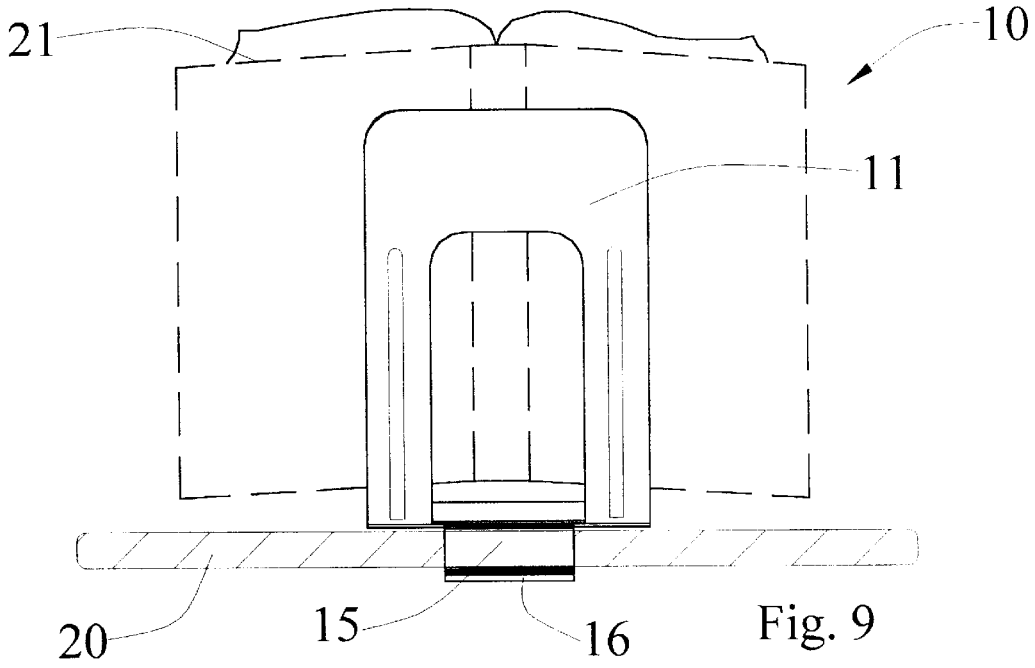
FIG. 9 is a rear elevation view of the apparatus of FIG. 1 shown holding a book in the open position.
Figure 10:
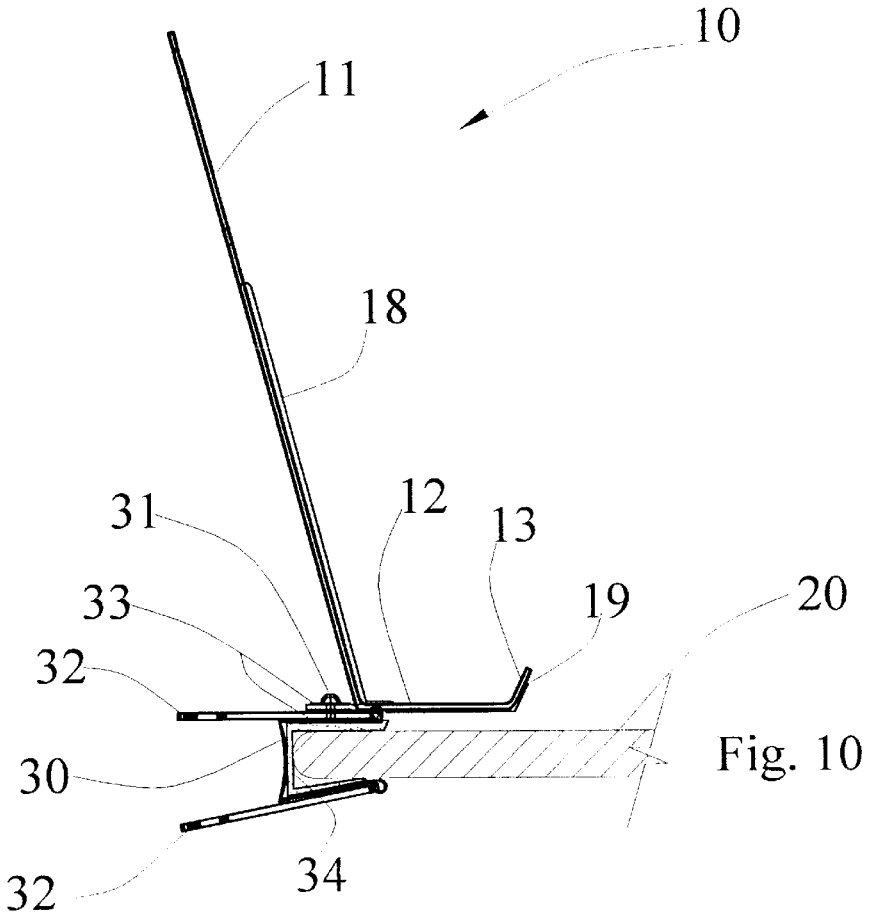
FIG. 10 is a side elevation view of a second embodiment of the apparatus in accordance with the invention that includes an adjustable clip on the desk
Figure 11:
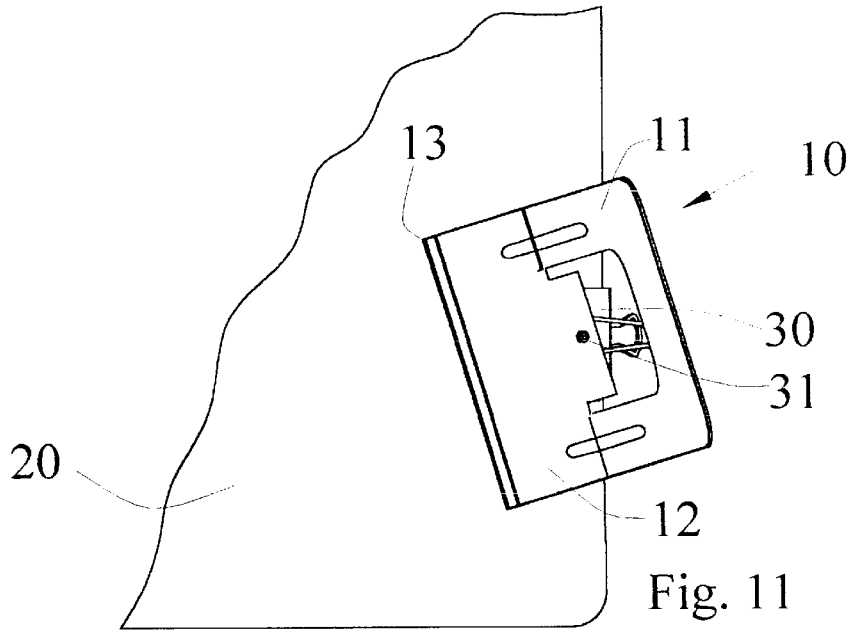
FIG. 11 is a plan view of the apparatus of FIG. 9 showing the book holder installed on a school desk in an offset position.

In another embodiment of the invention, illustrated in FIGS. 9 and 10 the apparatus is generally similar to the apparatus described above. However, in addition the apparatus includes a C-shaped spring 30 that is dimensioned and configured for engagement with the edge of a school desk 20. Handles 32, 32 engage the free ends of the C-shaped spring 30 in the same general manner as a conventional binder clip. The user may by squeezing ends of the handles 32, 32 together spread the C-shaped spring to allow easy engagement with the desk. 20. The fastener 31 and the washer 33 fix the C-shaped spring 30 to the rest of the apparatus 10. The friction slip washer between the clamp and base allows the book holder to swivel in any angle with a slight force while attached securely to the desk by the spring steel clamp.

It will thus be seen that this form of the apparatus in accordance with the invention provides a mechanism that allows engagement with desktops of varying thickness, as well, as a superior engagement.

The term book has been used herein to describe the article on which indicia appears. As used herein the term "book" is intended to cover even a sheet of paper or other media having visible indicia thereon.

Those skilled in the art will upon seeing this disclosure recognize various modifications and additions to the apparatus of the present invention. It is intended that the scope of the present invention be limited only by the claims which follow.

What is claimed is:

1. Apparatus for holding an associated open book on which some indicia appears which comprises:

means for gripping an associated work surface which comprises a generally U-shaped clamp dimensioned and configured for engaging an associated generally horizontal planar work surface and said means for gripping includes a generally C-shape spring clamp;

means for supporting an associated article on which indicia appears, said means for supporting being fixed to said means for gripping and being a first generally planar member and said generally planar member has an opening formed therein and further includes a friction slip washer disposed between the C-shaped spring damp and the rest of the apparatus to allow the apparatus to swivel to any of a plurality of angles while attached securely to the associated desk by the C-shaped spring steel damp.

2. Apparatus for holding an associated open book on which some indicia appears which comprises:

means for gripping an associated work surface which comprises a generally U-shaped damp dimensioned and configured for engaging an associated generally horizontal planar work surface and said means for gripping includes a generally C-shape spring clamp;

means for supporting an associated article on which indicia appears, said means for supporting being fixed to said means for gripping and being a first generally planar member and further includes means for pivoting the meetings for supporting with respect to said means for gripping to allow the means for supporting to swivel to any of a plurality of angles while attached securely to the associated desk by the C-shaped spring steel clamp and further includes means for constraining pivotal movement of said means for supporting with respect to said means for gripping and said means for constraining pivotal moment is a washer.

3. The apparatus in accordance with claim 2 wherein said washer is a friction slip washer.

* * * * *